US007854499B2

(12) United States Patent
Udagawa

(10) Patent No.: US 7,854,499 B2
(45) Date of Patent: Dec. 21, 2010

(54) LIQUID HOUSING CONTAINER

(75) Inventor: Kenta Udagawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 817 days.

(21) Appl. No.: 11/828,222

(22) Filed: Jul. 25, 2007

(65) Prior Publication Data

US 2008/0030557 A1 Feb. 7, 2008

(30) Foreign Application Priority Data

Aug. 3, 2006 (JP) ..... 2006-212297

(51) Int. Cl.
*B41J 2/175* (2006.01)

(52) U.S. Cl. ..... 347/86; 347/84

(58) Field of Classification Search ..... 347/84, 347/85, 86, 87; 251/30.03, 88, 149.2, 160
See application file for complete search history.

(56) References Cited

U.S. PATENT DOCUMENTS

| | | | | |
|---|---|---|---|---|
| 5,784,088 | A | 7/1998 | Ujita et al. | 347/86 |
| 6,145,972 | A | 11/2000 | Udagawa et al. | 347/86 |
| 6,158,849 | A | 12/2000 | Veciana et al. | 347/85 |
| 6,244,695 | B1 | 6/2001 | Udagawa | 347/86 |
| 6,382,786 | B2 | 5/2002 | Iwanaga et al. | 347/86 |
| 6,390,611 | B1 * | 5/2002 | Kobayashi et al. | 347/84 |
| 6,416,173 | B2 | 7/2002 | Kishida et al. | 347/86 |
| 6,419,349 | B1 | 7/2002 | Iwanaga et al. | 347/86 |
| 6,527,381 | B1 | 3/2003 | Udagawa et al. | 347/86 |
| 6,582,068 | B2 * | 6/2003 | Ishizawa et al. | 347/85 |
| 6,652,949 | B2 | 11/2003 | Iwanaga et al. | 428/65.9 |
| 6,666,552 | B2 * | 12/2003 | Anderson et al. | 347/86 |
| 6,742,881 | B2 | 6/2004 | Kotaki et al. | 347/86 |
| 6,969,161 | B2 * | 11/2005 | Kuwabara et al. | 347/85 |
| 2004/0183870 | A1 | 9/2004 | Steinmetz et al. | 347/85 |
| 2005/0140749 | A1 | 6/2005 | Usui et al. | 347/84 |

FOREIGN PATENT DOCUMENTS

| | | |
|---|---|---|
| EP | 778143 | 6/1997 |
| EP | 832748 | 4/1998 |
| JP | 2519871 | 5/1996 |
| JP | 2727292 | 12/1997 |
| JP | 10-128992 | 5/1998 |
| JP | 10-235892 | 9/1998 |
| JP | 2866068 | 12/1998 |
| JP | 2005-193636 | 7/2005 |
| JP | 2005-199516 | 7/2005 |
| JP | 2006-43922 | 2/2006 |

* cited by examiner

*Primary Examiner*—Anh T. N. Vo
(74) *Attorney, Agent, or Firm*—Fitzpatrick, Cella, Harper & Scinto

(57) ABSTRACT

The present invention provides a liquid housing container that enables an increase in the channel cross section of a connection portion of a liquid channel that allows a liquid housing chamber to communicate with an exterior, allowing pressure loss to be minimized. A supply needle 107 is pushed into a liquid housing container to move, to an open position, a valve 102A. With the valve 102A remaining in the open position, the supply needle 107 is pushed back and held separate from the valve 102A. Subsequently, the supply needle 107 is pushed into the liquid container again to move the valve 102A to a closed position. Even when the supply needle 107 is removed from the liquid housing container, the valve 102A is held in the closed position.

12 Claims, 16 Drawing Sheets

LIQUID HOUSING CONTAINER

BACKGROUND OF THE INVENTION

1. Field of the Invention

The present invention relates to a liquid housing container, and in particular, to a liquid housing container comprising a liquid supply connection portion.

2. Description of the Related Art

Liquid containers used in ink jet printing apparatuses may be integrated with or separated from print elements. A liquid container integrated with a print element can be easily replaced with a new one. Further, every time the container with ink used up is replaced with a new one, the print element is also replaced with a new one. Every time a print element has been used for a specified time, printing can be performed with a new print element.

On the other hand, for a liquid container separated from a print element, only the container needs to be replaced. This advantageously reduces the costs of replacement parts. However, the liquid container separated from the print element requires a liquid connection portion through which the print element is supplied with ink.

As a method for liquid connection, various systems have been adopted for ink jet printing apparatuses.

An example of a liquid container containing an ink absorbent with a capillary force in order to impregnate the ink absorbent with ink is a liquid container including an ink guiding member made of a bundle of fibers as disclosed in Japanese Patent Publication No. 2727292. Liquid connection based on the pressure contact of the ink guiding member with a filter in a printing apparatus is commonly adopted. This system advantageously uses a simple structure and allows the ink in the ink absorbent to be reliably consumed. However, ink jet printing apparatuses have been desired to exhibit improved filtering performance in order to deal with finer droplets ejected therefrom. Further, there has been a demand for an increase in the amount of ink flowing in per unit time during ink supply in order to reduce printing time. An increase in the amount of inflow ink is likely to increase the impact of possible pressure loss in a filter portion during ink supply. Measures such as an increase in the area of the filter have thus been required to prevent the possible pressure loss. However, this in turn requires a large opening, possibly causing the surroundings to be stained with ink during operation.

In contrast, to avoid the surface contact between the liquid container and the printing apparatus, a connection system based on a needle and a rubber plug has been proposed. Japanese Patent Publication No. 2519871 discloses a liquid container using a rubber plug. Liquid connection is established by sticking, into a rubber plug in a liquid container, a needle which is hollow and which has a sharp tip and a hole normally formed in its side surface and serving as a liquid channel. FIG. 29 of Japanese Patent Laid-Open No. 10-128992 and FIG. 7 of Japanese Patent Laid-Open No. 10-235892 disclose a configuration in which a rubber plug with a hole already formed therein is assembled in a liquid container. This configuration enables the printing apparatus and the liquid container to be connected together even if the needle does not have a sharp tip. These systems allow the connection function to be achieved by the simple structure.

However, these systems use only the restoring force of the rubber plug to prevent leakage of ink when the liquid connection is canceled. After the connection between the rubber plug and the needle is maintained for a long period, the hole in the rubber plug may not be completely closed during non-connection, depending on the material characteristics of the rubber plug or the diameter of the needle stuck into the rubber plug.

As a structure closing the hole during non-connection, a known system closes a hole formed in a rubber plug using a valve biased by a spring as disclosed in Japanese Patent Publication No. 2866068.

FIGS. 14A to 14C are cross-sectional views showing the configuration of a liquid container based on a system of closing a hole by means of a spring. Reference character R denotes an internal chamber in the liquid container. Reference numerals 902, 903, and 904 denote a valve, a spring, and a spring receiver, respectively. Reference numerals 906 and 907 denote an elastic body and a supply needle, respectively.

FIG. 14A is a diagram showing the internal structure of a supply connection portion of the liquid container. In the liquid container shown in FIG. 14A, the supply needle 907 is hollow and has a flat tip and a hole 907A in its side surface which serves as a liquid channel. The supply needle 907 shown by an alternate long and two short dashes line is moved to a position shown by a solid line to push the valve 902 shown by an alternate long and two short dashes line into the position of the valve 902 shown by a solid line, that is, into the internal chamber R in the liquid container. This results in the formation of a liquid channel.

FIG. 14B shows a connection portion valve structure of an ink housing bag (liquid container) disclosed in Japanese Patent Laid-Open No. 2005-199516. In a liquid container shown in FIG. 14B, the supply needle 907 has a sharp tip and a plurality of small-diameter holes 907B around the tip. The supply needle 907 shown by an alternate long and two short dashes line is moved to a position shown by a solid line to push the valve 902 shown by an alternate long and two short dashes line into the position of the valve 902 shown by a solid line, that is, into the internal chamber R in the liquid container. This results in the formation of a liquid channel.

FIG. 14C shows an example in which liquid connection is established using the gap between the supply needle and the valve; this configuration is disclosed in Japanese Patent Laid-Open No. 2005-193636 and U.S. Patent Publication No. 20040183870. In a liquid container shown in FIG. 14C, the supply needle 907 has an open tip and a recessed and projecting portion 907C in a circumferential portion of the tip. The supply needle shown by an alternate long and two short dashes line is moved to a position shown by a solid line to push the valve 902 shown by an alternate long and two short dashes line into the position of the valve 902 shown by a solid line, that is, into the internal chamber R in the liquid container. This results in the formation of a liquid channel through the gap between the valve 902 and the supply needle 907.

In these structures, the needle and the valve are in contact with each other to prevent a filter from being exposed to a liquid connection portion. Thus, the structure of the connection portion does not depend on the filter area. This makes the connection portion unlikely to be stained in spite of possible malfunction, while ensuring the appropriate filter area.

Japanese Patent Laid-Open No. 2006-043922 discloses a configuration in which the connection between the liquid housing container and the printing apparatus is such that the connection portion except for an ink supply portion is not closed. Specifically, in the ink supply portion, the liquid housing container and the printing apparatus (tank holder) are connected together via a closing seal portion. In the connection portion except for the ink supply portion, the liquid housing container and the printing apparatus are connected together using an alternate mechanism provided on a side surface of the liquid housing container.

FIG. 15 shows an example of an ink jet printing apparatus using a connection method disclosed in FIGS. 14A to 14C. Reference numeral 900 denotes an ink jet printing apparatus main body, and reference numeral 901 denotes a liquid container. In this ink jet printing apparatus, a print element (not shown) scans a print medium to print the surface of the print medium P. In connection with the print element, the liquid container 901 is installed at a specified position of the printing apparatus main body 900. In FIG. 15, four liquid containers 901 are installed on a front surface of the printing apparatus main body 900.

FIG. 16 is a diagram showing an example of the liquid container 901. Reference numeral 908 denotes a liquid supply portion. In this example, the liquid container 901 is shaped like a box. The liquid supply portion 908 is provided on an end surface of the liquid container 901 located in an installation direction (the direction of an arrow). The liquid container normally comprises a rubber plug or a valve as described above which is joined to a supply needle provided in the printing apparatus main body, In recent years, the printing speed of ink jet printing apparatuses has been further increased. For the system based on the connection of the supply needle, reducing pressure loss has become important because of an increase in the amount of ink supplied per unit time. Moreover, the number of ink types has been increasing. For example, pigment ink tends to be more viscous than conventional dye ink, contributing to further increasing pressure loss.

Further, some ink jet printing apparatuses do not supply ink from ink tanks during printing but during non-printing. Since no ink is supplied during printing, the pressure on the ink supplied to the print element is unlikely to vary. This prevents ink ejection from being affected by a possible variation in ink pressure, allowing accurate ejection.

However, when the ink from the ink tank is not supplied during printing but during non-printing, the supply of a sufficient amount of ink for printing needs to be completed in a short time because ink supply is performed only during non-printing. This is because the time for non-printing needs to be reduced in keeping with increasing printing speed of ink jet printing apparatuses. When the ink is supplied only during non-printing, a sufficient amount of ink needs to be supplied in a short time, so that the ink fed from the ink tank often flows faster than when the ink is always supplied. In this case, the pressure variation per unit time associated with ink supply increases, resulting in increased pressure loss.

To reduce the pressure loss, it is important to maximize the cross section of a channel through which ink passes. However, if a side hole is present in a side of the tip of a hollow needle as in the case of the liquid container disclosed in Japanese Patent Laid-Open No. 10-235892, it is difficult in connection with a manufacturing process to increase the diameter of the side hole; the size of the side hole is limited.

Further, in the liquid container shown in FIG. 14C, since the tip of the supply needle 907 abuts against the valve member 902, a recessed gap in the tip 907C of the supply needle 907 constitutes an ink channel. In this liquid container, the ink channel can be widened by increasing the width or depth of the recessed shape in the tip 907C of the supply needle 907. However, to fulfill the function of abutting the valve 902 against the needle, it is necessary to ensure the area in which the valve 902 abuts against the needle. This prevents the ink channel from being easily widened. Further, to reduce the ink pressure loss associated with the supply needle 907 itself, the inner diameter of the needle needs to be increased. However, an increase in the outer diameter of the needle in the connection portion may affect the closability during connection as well as installing operability. Moreover, an increase in the inner diameter and a reduction in the thickness of the supply needle 907 with its outer diameter unchanged make it difficult to increase the depth of the recess in the tip 907C of the supply needle 907 owing to the need to maintain the rigidity of the needle.

For the liquid container shown in FIG. 14B, in the conventional example, the supply needle 907 is made by molding resin. In this case, ink passes through the thin hole 908B, and the pressure loss in this portion needs to be reduced. However, the intervals of the holes 907B, through which the ink passes, depend on the fluidity of the resin and the strength of a mold during molding. This makes it difficult to reduce the intervals of the holes 907B to increase the number of holes 907B formed or to increase the inner diameter of the holes 907B.

SUMMARY OF THE INVENTION

The present invention is implemented in view of the above problems. An object of the present invention is to provide a liquid container and a printing apparatus in which a liquid channel formed when an opening and closing valve is open has an increased cross section, allowing pressure loss to be minimized.

Thus, a liquid container in accordance with the present invention comprises a liquid channel that is in communication with a liquid housing chamber and an opening and closing valve provided in the liquid channel and which is opened and closed by moving a valve element between an open position and a closed position. The liquid container is characterized by a mechanism that alternately repeats a holding operation of holding the valve element in the open position and a releasing operation of releasing the holding of the valve element in the open position to allow the valve element to move to the closed position, every time the valve element is pushed in a direction from exterior to interior of the liquid housing chamber.

The above configuration alternately repeats the operation of holding the valve element in the open position and the operation of releasing the holding every time the valve element, provided in the liquid channel, is pushed. After the valve is pushed in, a needle tip is out of contact with the valve. This increases the cross section of the channel to reduce the loss of the ink pressure at the needle tip.

The present invention can increase the cross section of a liquid channel formed by opening the valve, suppressing the pressure loss.

Further features of the present invention will become apparent from the following description of exemplary embodiments (with reference to the attached drawings).

DESCRIPTION OF THE EMBODIMENTS

Embodiments of the present invention will be described below with reference to the drawings.

First Embodiment

Figure 1:
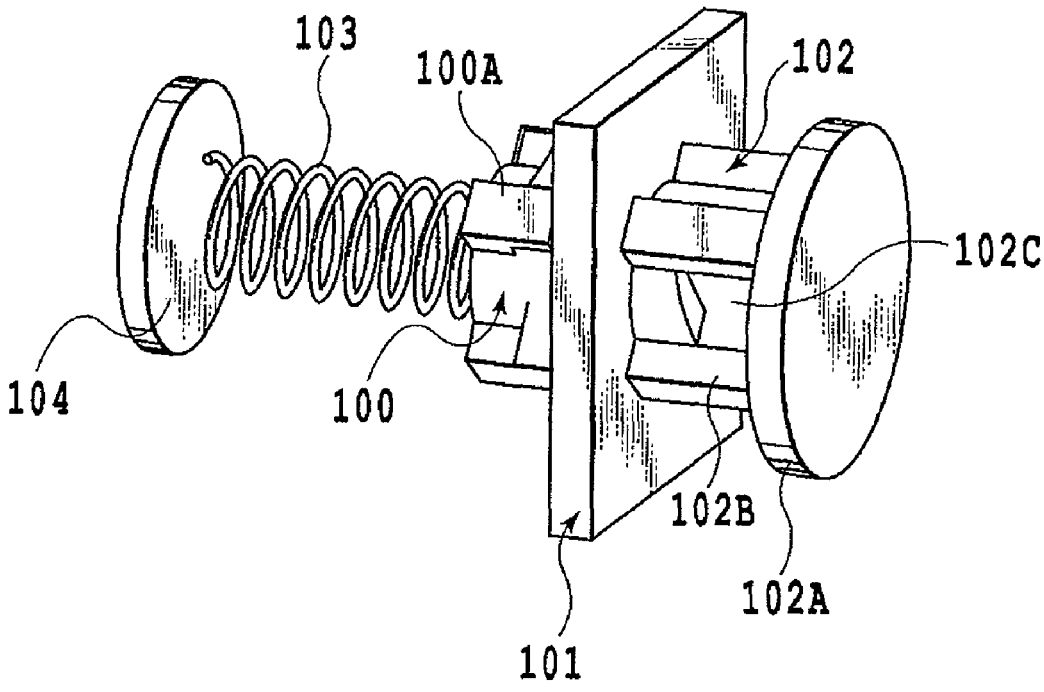
FIG. 1 is a perspective view showing the internal structure of a supply connection portion in accordance with a first embodiment.
Figure 2A:
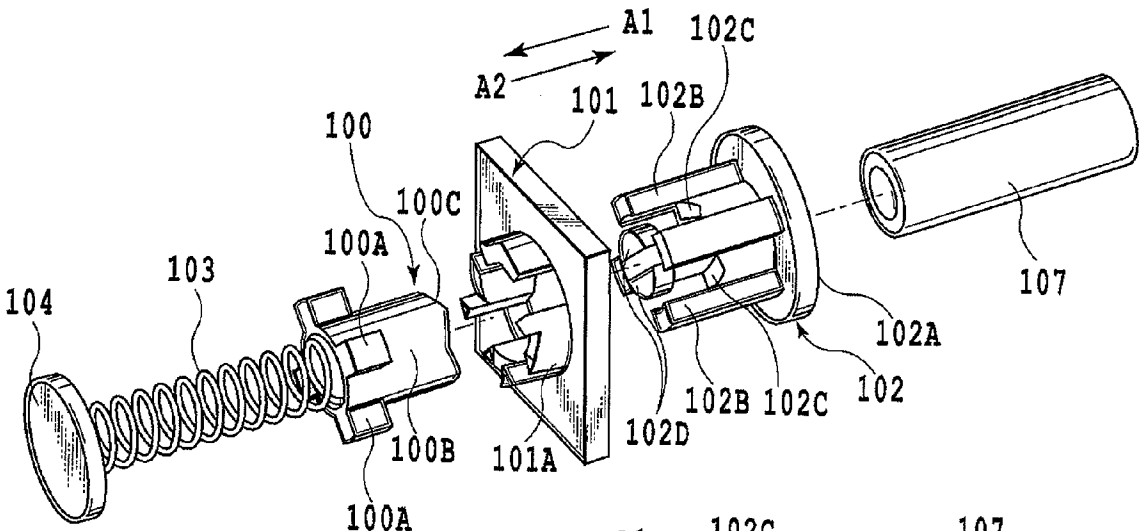
FIG. 2A is a perspective view showing the internal structure of the supply connection portion in accordance with the first embodiment as viewed from a valve side.
Figure 2B:
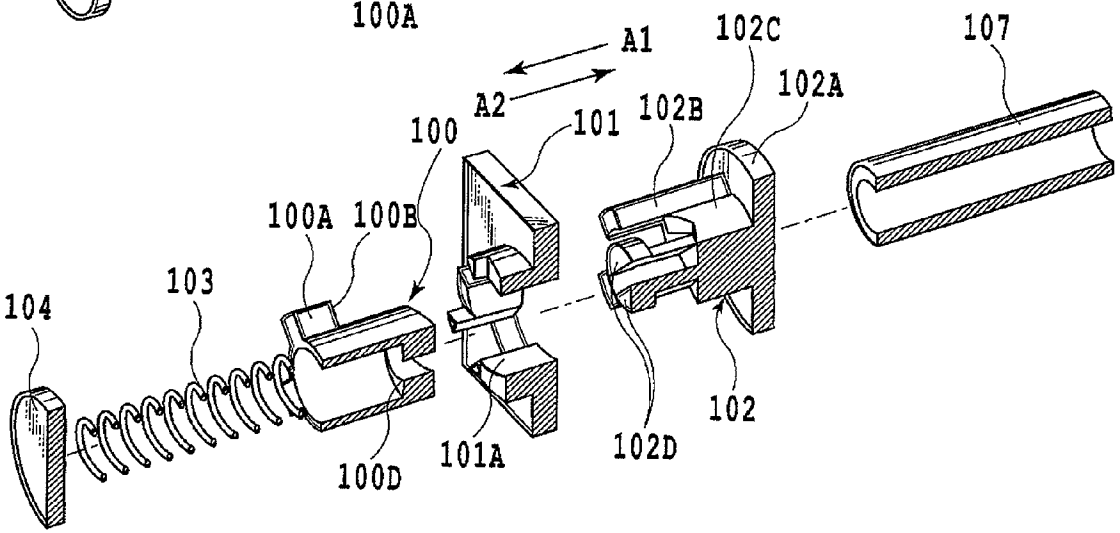
FIG. 2B is a perspective view showing the internal cross section structure of the supply connection portion in accordance with the first embodiment as viewed from a valve side.
Figure 3A:
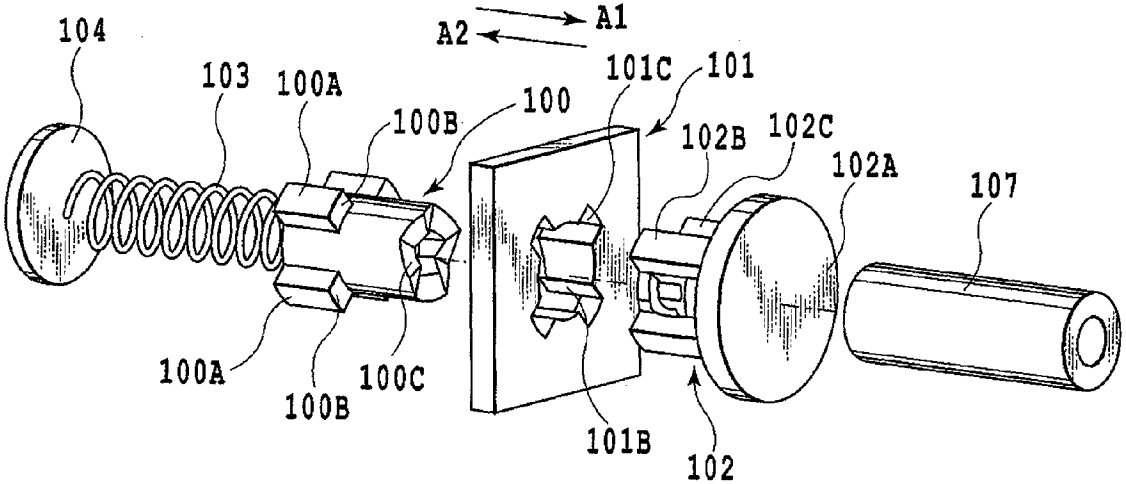
FIG. 3A is a perspective view showing the internal structure of the supply connection portion in accordance with the first embodiment as viewed from a supply needle side.
Figure 3B:
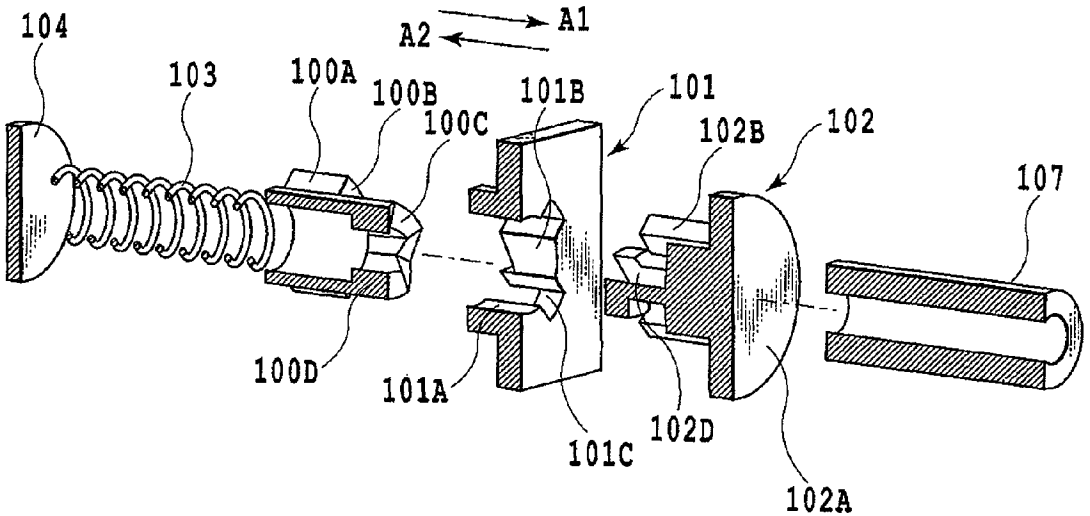
FIG. 3B is a perspective view showing the internal cross section structure of the supply connection portion in accordance with the first embodiment as viewed from a supply needle side.

FIGS. 1, 2A, 2B, 3A and 3B are perspective views showing the internal structure of a supply connection portion in accordance with the present embodiment of the present invention. FIG. 1 is a perspective view of a combination of members of the supply connection portion. FIGS. 2A-B and 3A-B are a perspective view and a sectional perspective view of members of the supply connection portion.

Reference numerals 100 and 101 denote a rotator and a fixed guide, respectively. Reference numeral 102 denotes an operation member having a valve 102A. Reference numeral 103 denotes a bias spring that is an elastic member. Reference numeral 104 denotes a spring receiver. Reference numeral 107 denotes a supply needle that pushes in the operation member 102. The other members are omitted from FIGS. 1, 2A-B and 3A-B in order to describe functions.

The bias spring 103 biases the rotor 100 in a direction in which the rotor 100 abuts against the operation member 102.

The rotator 100 allows what is called an alternate operation to be performed. Four abutting portions 100A are provided on the bias spring 103 side of the rotor 100 to abut against a corrugated guide portion 101A provided on the fixed guide 101. The operation member 102 side of the abutting portion 100A constitutes an inclined abutting surface 100B. An inclined engaging surface 100C is provided on the operation member 102 side of the rotor 100 to engage with a serrated engaging portion 102C provided on the operation member 102. As conceptually shown in FIGS. 4A-D, a part of the engaging surface 100C located at the same position as that of the abutting surface 100B constitutes a surface inclined in the same direction as that of the abutting surface 100B in the peripheral direction of the rotor 100.

The fixed guide 101 uses a guide portion 101A to regulate movement of the rotor 100 and is provided, for example, in the liquid container at a specified position.

The operation member 102 is pushed in the direction of arrow A2 to rotate the rotor 100 as described above. The operation member 102 comprises a valve 102A that opens and closes a supply connection portion comprising an elastic member 106 (see FIGS. 4A-D) described below. The operation member 102 comprises a coupling portion 102D that is coupled to the rotor 100. The coupling portion 102D is inserted into the rotor 100. The coupling portion 102D then has its diameter temporarily reduced and then increased and is thus locked on a step 100D inside the rotor 100. The rotor 100 and the operation member 102 are thus coupled together so as to be rotatable relative to each other and to be movable relative to each other within a predetermined range in the directions of arrows A1 and A2. The operation member 102 also comprises four coupling legs 102B locked on the fixed guide 101. Four increased diameter portions 101C are formed around the periphery of a coupling hole 101B in the fixed guide 101. The coupling legs 102B are fitted into the corresponding increased diameter portions 101C of the coupling hole 101B to lock the operation member 102 in the fixed guide 101. Consequently, the operation member 102, locked in the fixed guide 101, is allowed to move in the directions of arrows A1 and A2.

FIGS. 4A-D and 5A-C are diagrams illustrating an alternate operation in accordance with the present embodiment.

Figure 4A:
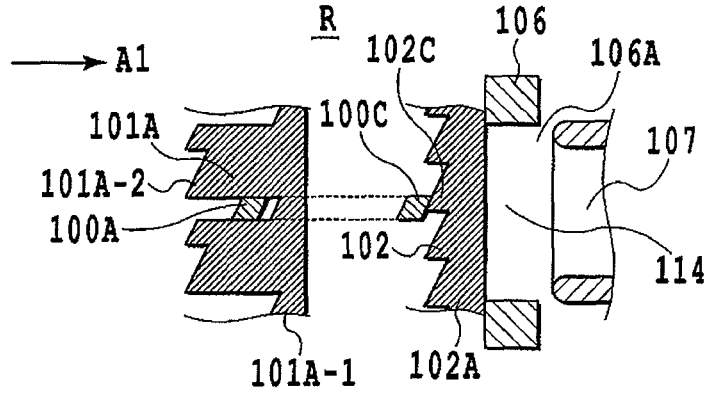
FIG. 4A is a diagram for an alternate operation performed when a liquid housing container is installed in a printing apparatus, showing that a valve is in pressure contact with an elastic body.

FIGS. 4A-D are diagrams for operations of members in the vicinity of the supply connection portion which are performed when the liquid housing container is installed in the printing apparatus. More specifically, FIGS. 4A-D show operations in which the valve 102A opens the supply connection portion comprising the elastic member (valve seat) 106. FIGS. 5A-C show operations of the members in the vicinity of the supply connection portion which are performed when the liquid housing container is removed from the printing apparatus. More specifically, FIGS. 5A-C show operations in which the valve 102A closes the supply connection portion again. In the present embodiment, the rotor 100 has the four abutting portions 100A. However, with reference to FIGS. 4A-D and 5A-C, the operation of one of the abutting portions 100A will be described.

The elastic member 106 in the present example is provided in the supply connection portion of the liquid container. A passage 106A is formed inside the elastic body 106 to allow the interior (the left of FIGS. 4A-D) R of the liquid container to communicate with the exterior (the right of FIGS. 4A-D). The passage 106A is closed by the valve 102A in the operation member 102 as shown in FIG. 4A. Reference numeral 107 denotes a tip of an ink supply needle (pipe) that is connected to an ink jet print head. In FIGS. 4A-D and 5A-C, the fixed guide 101 and the operation member 102 are shown with a part of the peripheral surface shape of each of these members spread out in order to describe the corrugated shapes of the guide portion 101A and engaging portion 102C of the fixed guide 101 and the operation member 102.

First, with reference to FIGS. 4A-D, operations of members in the vicinity of the supply connection portion which are performed when the liquid housing container is installed in the printing apparatus.

In FIG. 4A, the abutting portion 100A of the rotor 100 is positioned in a trough portion 101A-1 of the corrugated shape of the guide portion 101A of the fixed guide 100. The operation member 102 is biased by the spring via the rotor 100 to bring the valve 102A into pressure contact with the elastic body 106. In this state, the supply connection portion is closed to accommodate ink in the ink container while preventing it from flowing out of the container.

Figure 4B:
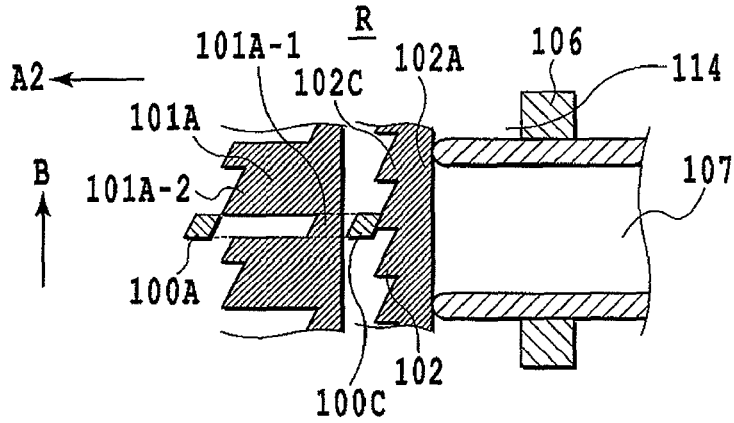
FIG. 4B is a diagram for the alternate operation performed when the liquid housing container is installed in the printing apparatus, showing that the valve has abutted against the supply needle.
Figure 5A:
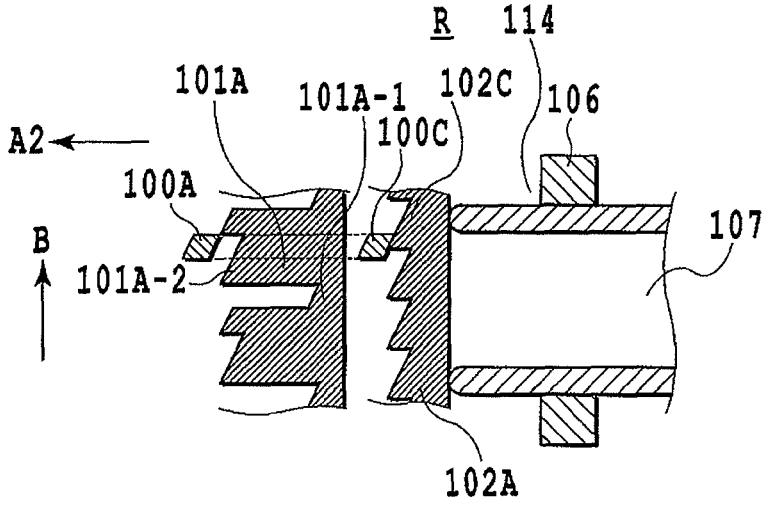
FIG. 5A is a diagram for an alternate operation performed when the liquid housing container is removed from the printing apparatus, showing that the supply needle is pushed into the printing apparatus.
Figure 5B:
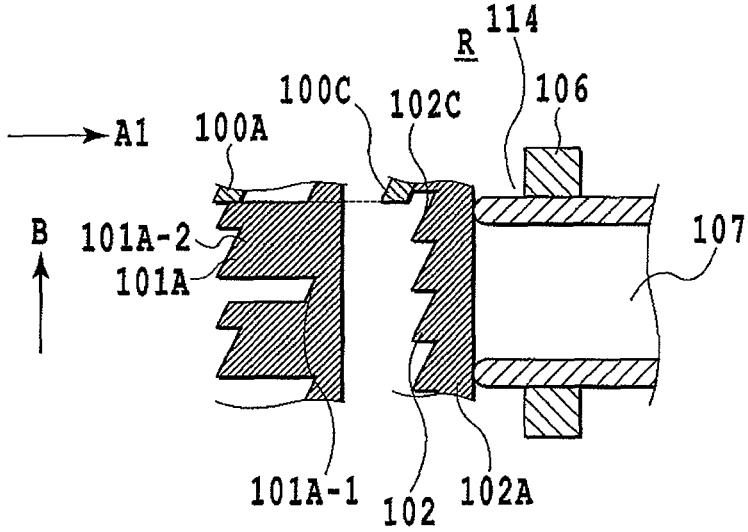
FIG. 5B is a diagram for the alternate operation performed when the liquid housing container is removed from the printing apparatus, showing that the rotor is rotated to move the abutting portion.
Figure 5C:
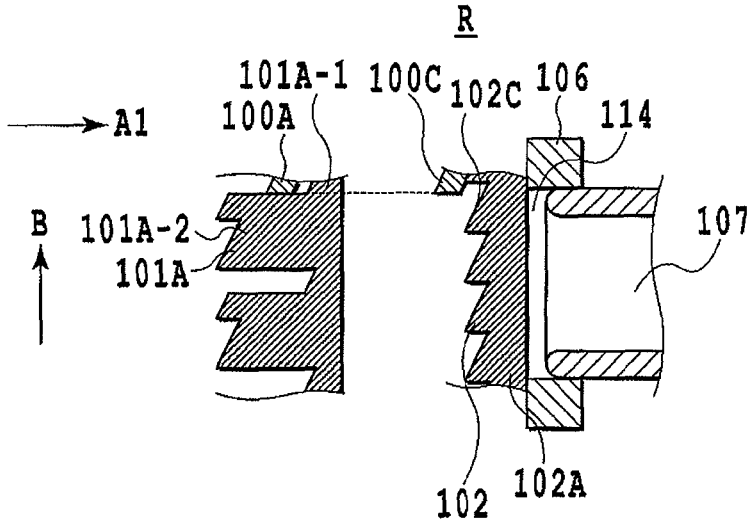
FIG. 5C is a diagram for the alternate operation performed when the liquid housing container is removed from the printing apparatus, showing that the valve abuts against the elastic body to block a liquid channel.

In FIG. 4B, the supply needle 107 inserted into the passage 106A in the elastic body 106 abuts against the valve 102A to push the operation member 102 and the rotor 100 in the direction of arrow A2 against the force of the bias member 103. At this time, the serrated engaging portion 102C of the operation member 102 acts on the engaging surface 100C of the rotor 100 to allow the rotor 100 to exert a rotating force in the direction of arrow B. However, the rotation of the rotor 100 is inhibited until the abutting portion 100A of the rotor 100 reaches a ridge portion 101A-2 of the guide portion 101A. An outer peripheral surface of the supply needle 107 comes into tight contact with an inner surface of the passage 106A, with the outer peripheral surface and the inner surface sealed. Pushing in the rotor 100 in the direction of arrow A2 by a specified distance releases the rotor 100 restricted by the fixed guide 101.

Figure 4C:
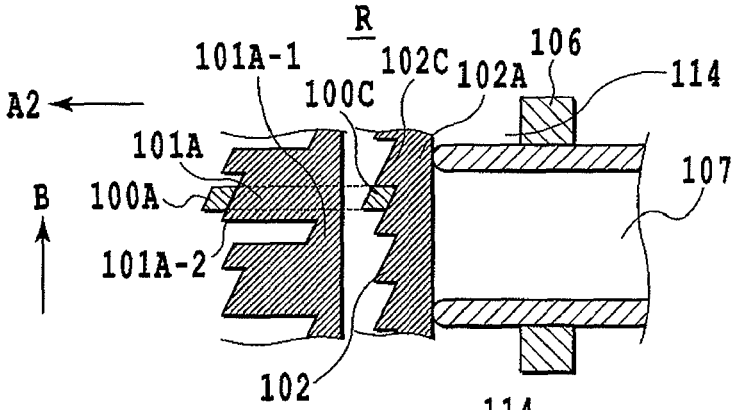
FIG. 4C is a diagram for the alternate operation performed when the liquid housing container is installed in the printing apparatus, showing that a rotor is rotated to move the abutting portion.

As a result, as shown in FIG. 4C, the rotor 100 rotates in the direction of arrow B to move the abutting portion 100A onto the ridge portion 101A-2 of the guide portion 101A of the fixed guide 100.

Figure 4D:
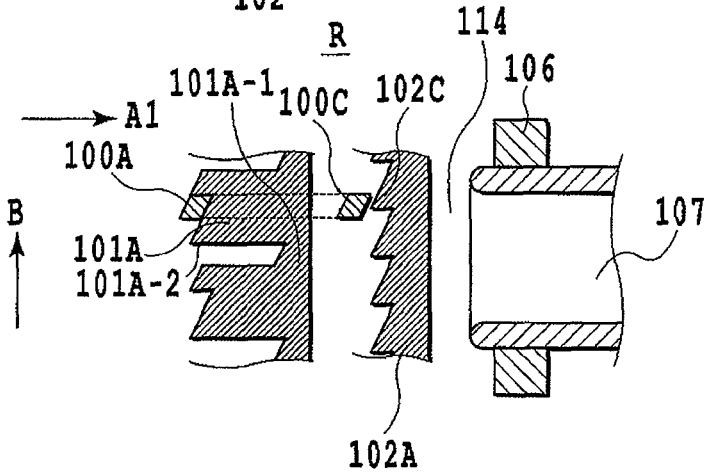
FIG. 4D is a diagram for the alternate operation performed when the liquid housing container is installed in the printing apparatus, showing that the valve has left the supply portion to open the supply connection portion.

Subsequently, as shown in FIG. 4C, supply needle 107 is returned in the direction of arrow A1 by a predetermined distance to abut the abutting portion 100A against the step of the ridge portion 101A-2 of the guide portion 101A. Thus, the rotation of the rotor 100 is inhibited. This locks the rotor 100 at a position which is reached by the rotor 100 after moving a predetermined distance in the direction of arrow A2. Consequently, as shown in FIG. 4D, the operation member 102 coupled to the rotor 100 is held at a position reached by the operation member 102 after moving in the direction of arrow A2. The valve 102A leaves the elastic member 106 to open the supply connection portion. In this state, the tip of the supply needle 107 is separate from and out of contact with the operation member 102. Thus, the space between valve 102A in the liquid channel 114 and the supply needle 107 serves as a liquid supply channel. The space has no obstacle offering such a liquid resistance as reduces the cross section of the liquid channel. Consequently, the present configuration efficiently feeds an amount of ink corresponding to the cross section of the liquid channel 114, from the liquid container to the print head. This enables the inhibition of possible pressure loss during liquid supply.

In this case, the supply needle 107 has been returned to the position where it comes into contact with the elastic member 106; the supply needle 107 remains in the liquid channel. This prevents the liquid from leaking from the connection potion when the liquid is fed from the liquid housing container to the print head.

In the present embodiment, as shown in FIG. 4D, the tip of the supply needle 107 is returned to the position where it comes into contact with the elastic member 106. However, provided that the supply needle remains in the liquid channel, the tip of the supply needle 107 need not necessarily be returned to the position where it comes into contact with the elastic member 106. However, the tip of the supply needle 107 is preferably returned to the position where it comes into contact with the elastic member 106 as in the case of the present embodiment. This is because the configuration of the present embodiment can create a larger space between the valve 102A and the supply needle 107 than the configuration in which the tip of the supply needle 107 is positioned closer to the liquid channel 114 than the elastic member 106, more effectively inhibiting possible pressure loss during liquid supply. That is, the present embodiment increases the cross section of the liquid channel 114.

Now, with reference to FIGS. 5A-C, description will be given of operations of the members in the vicinity of the supply connection portion which are performed when the liquid housing container is removed from the printing apparatus. When the liquid housing container is removed from the printing apparatus, it is necessary to cut off the liquid channel 114 from the exterior in order to prevent the liquid in the liquid housing container from leaking out of the liquid channel 114.

First, as shown in FIG. 5A, the supply needle 107 is pushed in again in the direction of arrow A2 to move the operation member 102 and the rotor 100 in the direction of arrow A2 against the force of the bias member 103.

Thus, the inclination of the engaging portion 102C of the operation member 102 and of the engaging surface 100C of the rotor 100 urges rotation of the rotor 100 in the direction of arrow B. However, the rotor 100 is inhibited from rotating until its abutting portion 100A passes over the step of the ridge portion 101A-2 of the fixed guide 101.

Once the abutting portion 100A passes over the step of the ridge portion 101A-2, the rotor 100 rotates in the direction of arrow B to move the abutting portion 100A to a position where it stands opposite the trough portion 101A-1. Subsequently, the supply needle 107 is pulled out in the direction of arrow A1 to move the rotor 100 in the direction of arrow A1 together with the operation member 102. The abutting portion 100A moves to the trough portion 101A-1. Then, the valve 102A of the operation member 102 abuts against the elastic body 106 to close the connection portion again to cut off the liquid channel 114 from the exterior.

In the present example, the supply connection portion is provided in the ink container (liquid container) for the ink jet printing apparatus. The supply needle 107 is provided in the printing apparatus.

The ink supply connection portion is opened and closed in conjunction with insertion and removal of the ink container. Installing the ink housing container through an alternate operation enables the ink connection supply portion to be automatically opened and closed for installation and removal. The ink supply connection portion may be opened and closed in conjunction with opening and closing of a cover in association with installation of an ink tank.

Figure 6A:
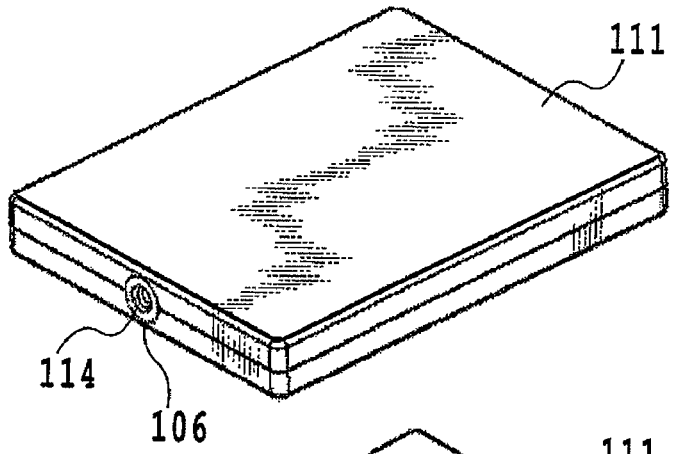
FIG. 6A is a perspective view showing a liquid housing container to which the first embodiment is applicable.
Figure 6B:
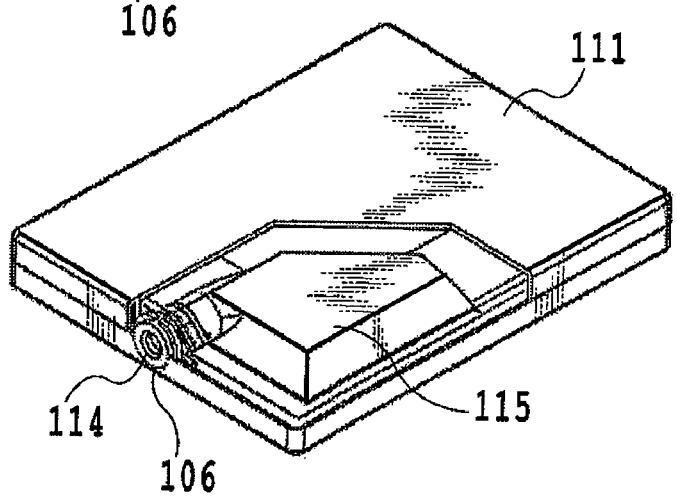
FIG. 6B is a perspective view showing essential parts of the liquid housing container.

FIGS. 6A-B are diagrams showing an ink housing container (liquid housing container) 111 to which the present invention is applicable.

FIG. 6A is a perspective view schematically showing the ink housing container 111. FIG. 6B is a perspective view showing essential parts of the ink housing container 111.

In FIGS. 6A-B, reference numerals 106 and 114 denote an elastic member and a liquid channel, respectively. Reference numeral 115 denotes a housing chamber which houses a liquid and which is in communication with the liquid channel 114.

Figure 7:
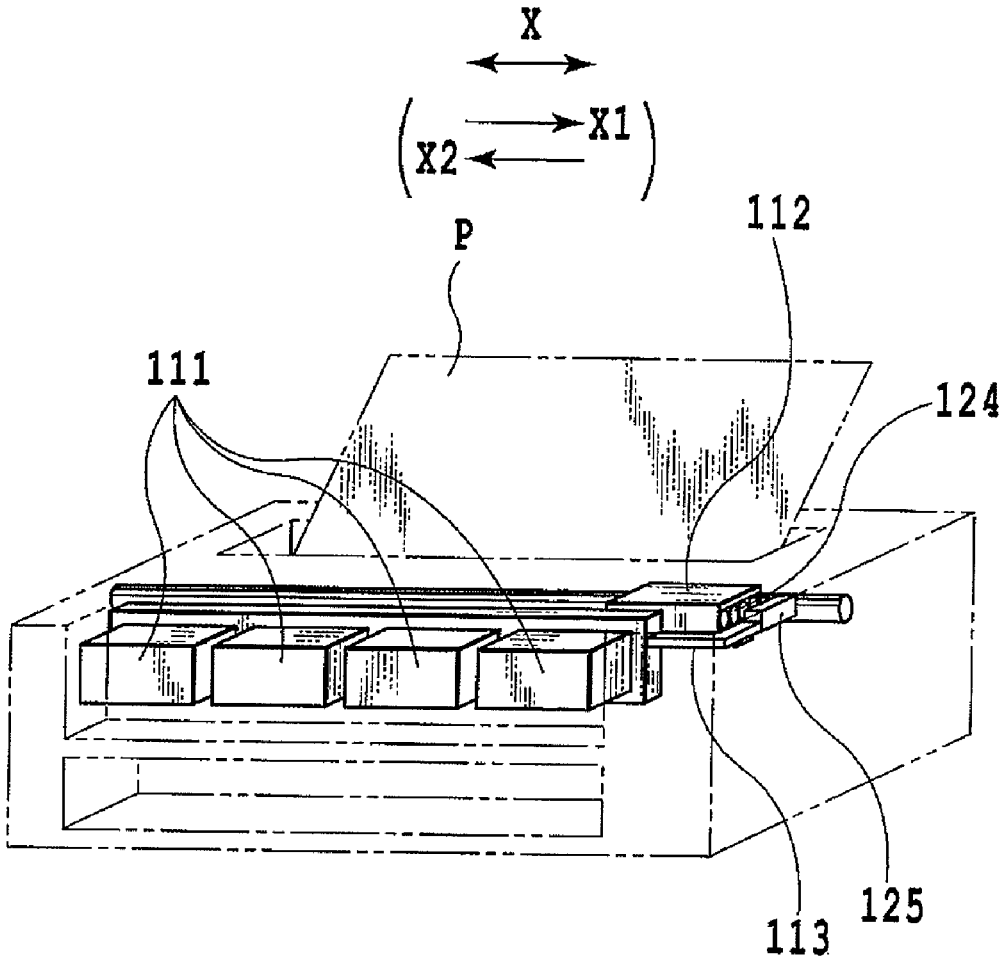
FIG. 7 is a perspective view showing an ink jet printing apparatus to which the first embodiment is applicable.
Figure 8:
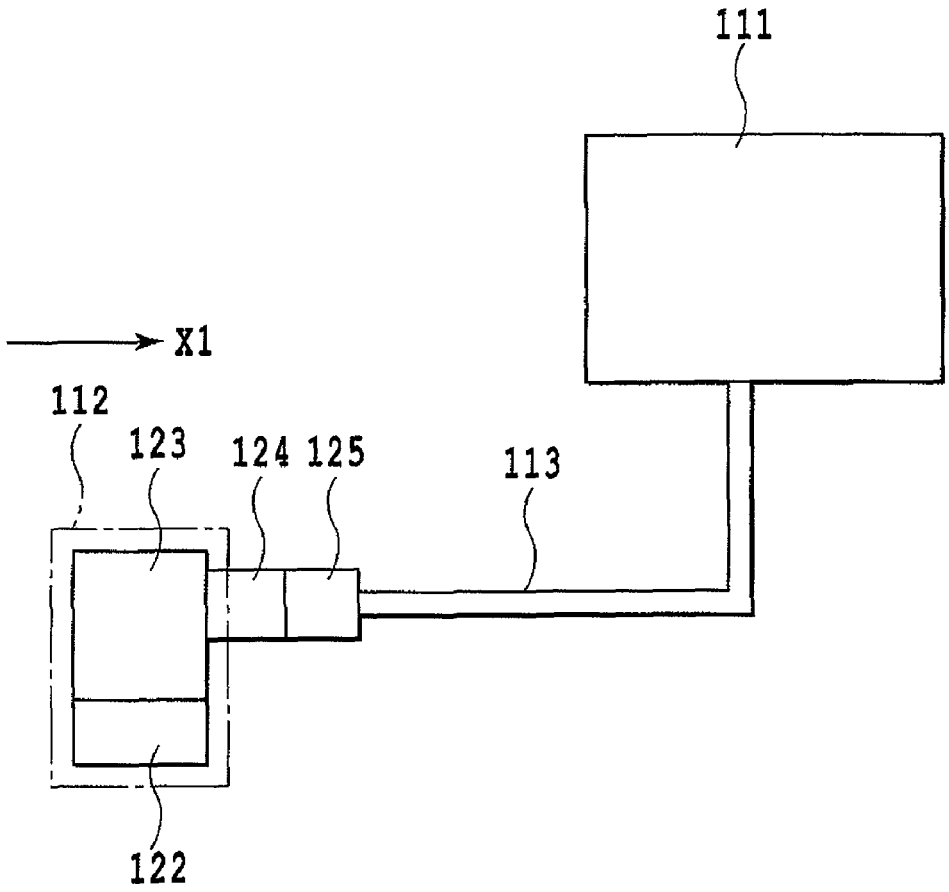
FIG. 8 is a diagram showing a print element applicable to the first embodiment.

FIG. 7 is a diagram showing a serial-scan ink jet printing apparatus to which the present invention is applicable. Reference numeral 111 denotes an ink tank which accommodates ink and which is installed at a specified position in the printing apparatus main body. Reference numeral 112 denotes a carriage on which a print head (not shown) is mounted and which is movable in a main scanning direction shown by arrow X. The carriage 112 integrally or separably comprises a print head 122 and a subtank 123 as shown in FIG. 8. In the present example, four ink supply paths are formed in association with four main tanks 111 accommodating different inks. Inks in the four main tanks 111 are supplied to the respective subtanks 123 and then ejected from ejection ports in the respective print heads 122 onto a print medium P. In FIG. 7, the liquid housing container 111 in accordance with the present invention is used as the main tank. The ink supply needle 107 is provided at an end of a supply path 113. The supply connection portion in accordance with the present invention is provided in the main tank 111. With reference to FIGS. 7 and 8, description will be given of another example of an ink housing container to which the present invention is applicable. In the printing apparatus in FIGS. 7 and 8, a supply connection portion 124 in accordance with the present invention may be provided in the subtank 123 provided on the carriage. In this case, a needle is provided in a connection portion 125 located at the tip of the ink supply path 113. The ink supply path 113 is connected to the main tank provided in the printing apparatus. The present invention is applied to an ink connection portion from the ink supply path 113 to the subtank.

The printing apparatus in the present example repeats a printing operation and an operation of conveying a print medium P to print an image. In the printing operation, the print head 122 ejects ink on the basis of print data while moving in the main scanning direction together with the carriage 112. In the conveying operation, the print medium P is conveyed by a predetermined amount in a sub-scanning direction crossing the main scanning direction, shown by arrow X.

The ink jet printing apparatus does not feed ink from the main tank 111 to the subtank 123 during printing but during non-printing. That is, the carriage moves in the direction of arrow X1 to abut the supply connection portion 124 against the connection portion 125 for connection. Consequently, movement of the carriage can be utilized to open and close the ink supply path.

Second Embodiment

According to the first embodiment of the present invention, the supply connection portion is provided in the liquid container, and the supply needle 107 is provided in the member different from the liquid container. However, the present invention is not limited to this configuration. An inclined portion 107A may be installed at the tip of the supply needle 107 to provide the supply needle 107 with the function (the function of performing an alternate operation) of the operation member 102 in accordance with the first embodiment.

Figure 9:
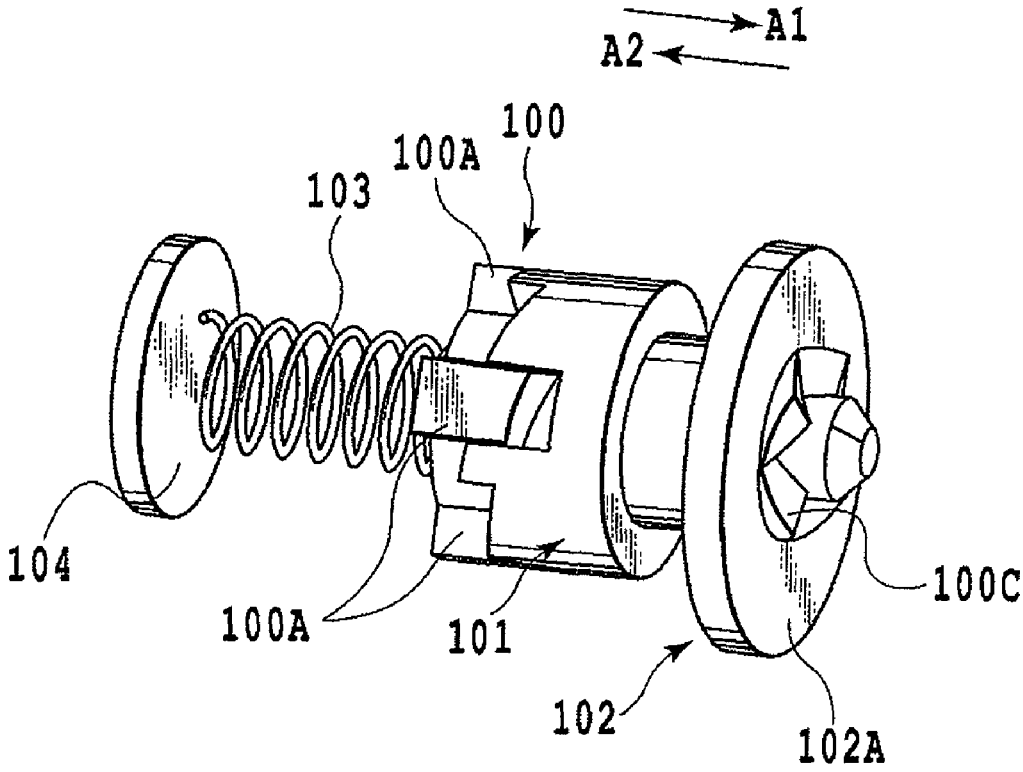
FIG. 9 is a perspective view showing the internal structure of a supply connection portion in accordance with a second embodiment.
Figure 10:
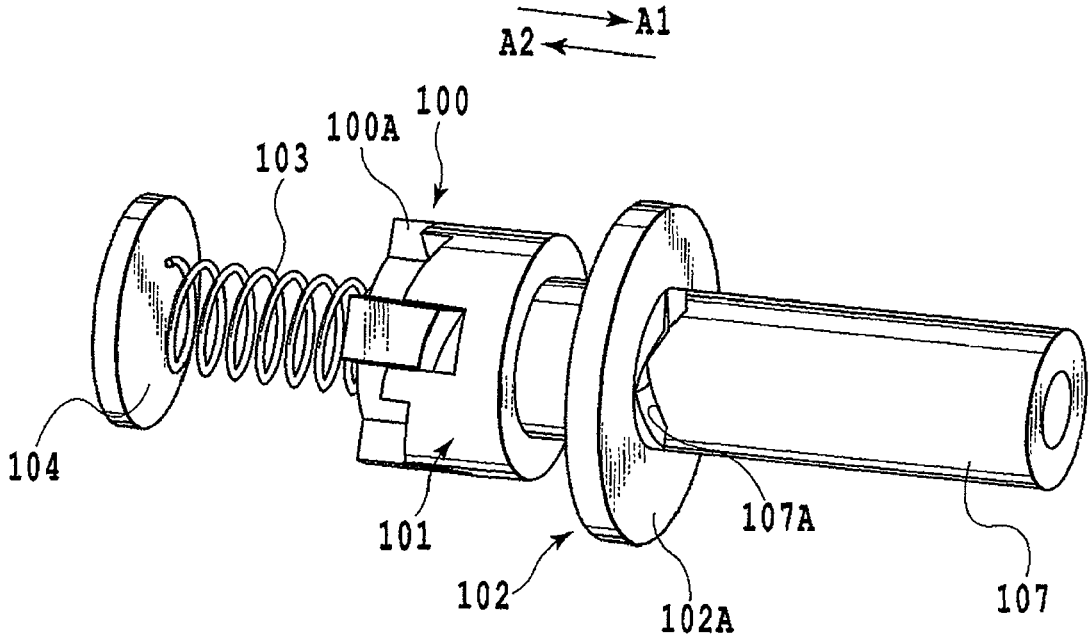
FIG. 10 is a perspective view showing the internal structure of the supply connection portion in accordance with the second embodiment.

FIGS. 9 and 10 are perspective views showing the internal structure of the supply connection portion in accordance with the present embodiment of the present invention. In the present example, the engaging surface 100C of the rotor 100 is exposed rightward from the operation member 102. Instead of the engaging portion 102C of the rotor 100, the engaging portion 107A is formed in the supply needle 107. Like the engaging portion 102C of the operation member 102, the engaging portion 107A has a function of engaging with the engaging surface 100C of the rotor to rotate the rotor 100.

Figure 11:
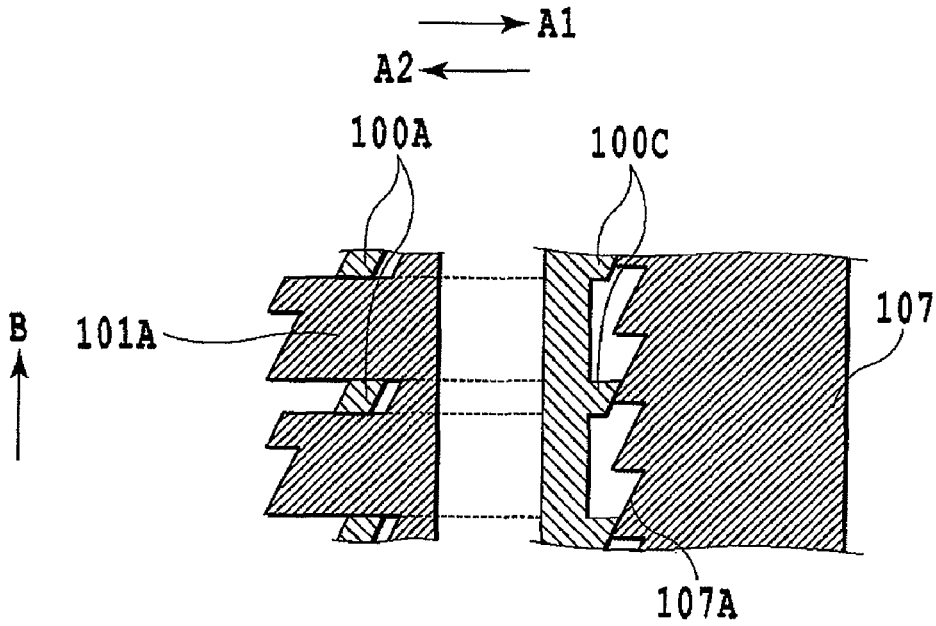
FIG. 11 is a diagram for an alternate operation in accordance with the second embodiment.

FIG. 11 is a diagram illustrating an alternate operation in accordance with the present embodiment.

The alternate operation itself is similar to that in accordance with the first embodiment of the present invention. The engaging portion 107A, located at the tip of the supply needle 107, functions similarly to the engaging portion 102C of the operation member 102. The present embodiment requires a reduced number of parts and allows functions similar to those of the first embodiment to be achieved using a simple configuration. Further, by associating the shape of the engaging portion 107A, located at the tip of the supply needle 107, with the inclination of the engaging surface 100C of the rotor 100, it is possible to prevent the alternate operation when an incorrect ink container is installed.

Third Embodiment

The alternate operations in accordance with the first and second embodiments are performed using the rotor 100, the fixed guide 101, and the operation member 102. However, in the present invention, the mechanism for the alternate operation is not limited.

Figure 12A:
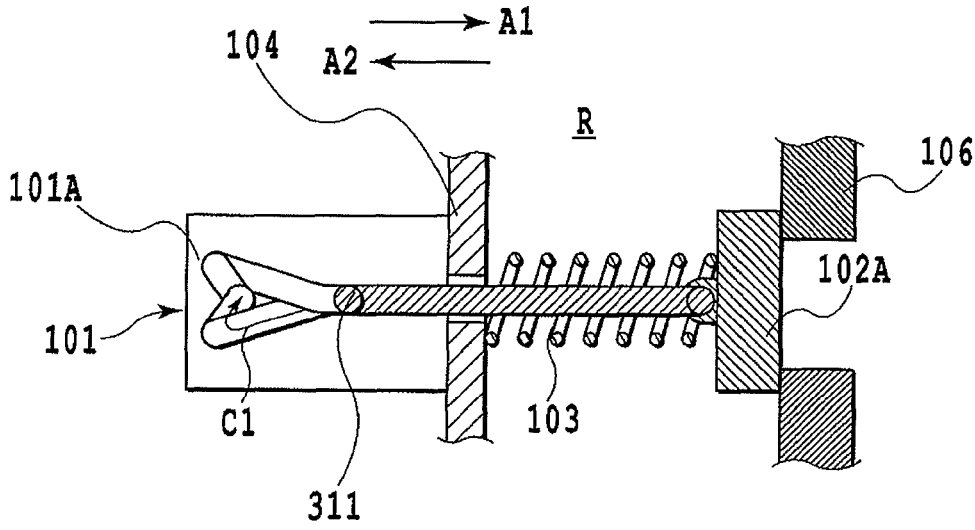
FIG. 12A is a cross-sectional view of the internal structure of a supply connection portion in accordance with a third embodiment, showing that a valve has closed a liquid channel.
Figure 12B:
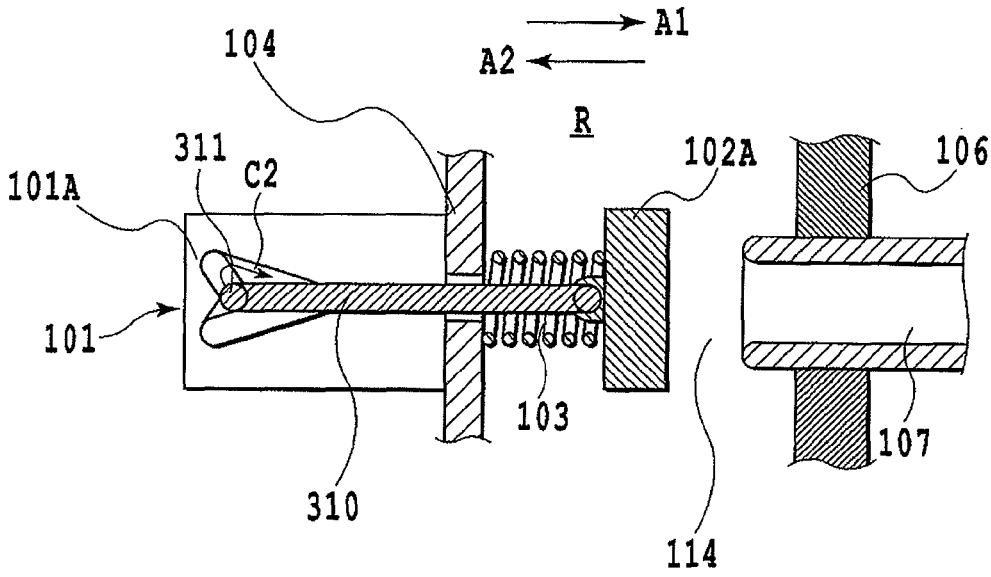
FIG. 12B is a cross-sectional view of the internal structure of the supply connection portion in accordance with the third embodiment, showing that the valve has opened the liquid channel.

FIGS. 12A-B are cross-sectional views showing the internal structure of the supply connection portion in accordance with a third embodiment of the present invention. In FIGS. 12A-B, reference numerals 310, 101, and 102A denote a lever (rod), a fixed guide, and a valve. Reference numerals 104 and 106 denote a spring receiver and an elastic body. The lever 310 allows an alternate operation to be performed. The fixed guide 110 regulates the movement of the lever. The valve 102A is connected to the lever 310 and abuts against the elastic body 106 to close the supply connection portion. The bias spring 103 biases the valve 102A in the direction in which the valve 102A abuts against the elastic body 106 as shown by arrow A1. In the position where the bias spring 103 is stretched, the lever 310 in accordance with the present embodiment causes the valve 102A to close the liquid channel 114, as shown in FIG. 12A. Then, when the supply needle 107 pushes in the valve 102A in the direction of arrow A2, a pin 311 located at the tip of the lever 310 moves along a heart-shaped guide groove 101A in the fixed guide 101 in the direction of arrow C1. As a result, the pin 311 moves to the position shown in FIG. 12B to inhibit the movement in the direction of arrow A1. Therefore, the bias spring 103 is kept compressed to allow the valve 102A to release the liquid channel 114.

Pushing in the supply needle 107 again in the direction of arrow A2 moves the pin 311 in the direction of arrow C2 as shown in FIG. 12B. As a result, the pin 311 returns to the position shown in FIG. 12A to stretch the bias spring 103 again to cause the valve 102A to close the liquid channel 114. The above rotating system, that is, the system of rotating the pin 311 along the guide groove 101A, also allows the alternate operation to be performed.

Moreover, with the liquid container comprising the supply connection portion in accordance with the present invention, if the valve 102A is inadvertently pushed in, the open state is maintained, possibly allowing air to enter the interior of the liquid container. When the entering air flows into the supply path or the print head, the pressure loss may be increased, printing operations may be affected, or the print head may be damaged. The inflow of air thus needs to be inhibited. Thus, the supply connection portion of the liquid container may have a check valve.

Figure 13:
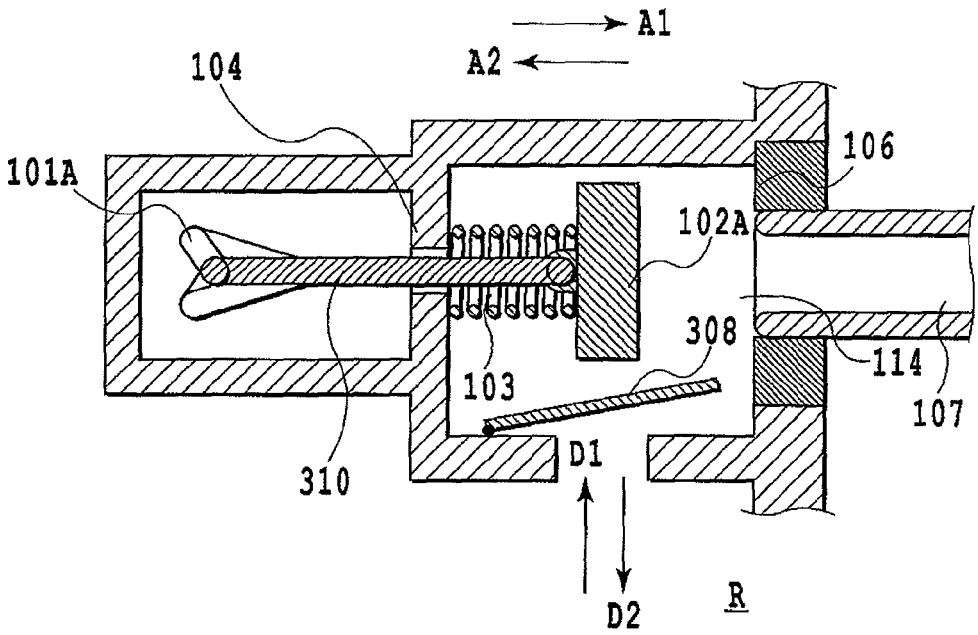
FIG. 13 is a cross-sectional view showing the internal structure of the supply connection portion comprising a check valve in accordance with the third embodiment.
Figure 14A:
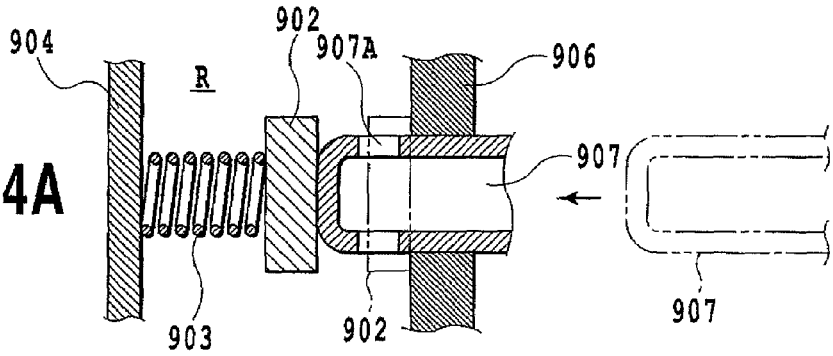
FIG. 14A is a cross-sectional view of a conventional supply connection portion in which a supply needle has a flat tip.
Figure 14B:
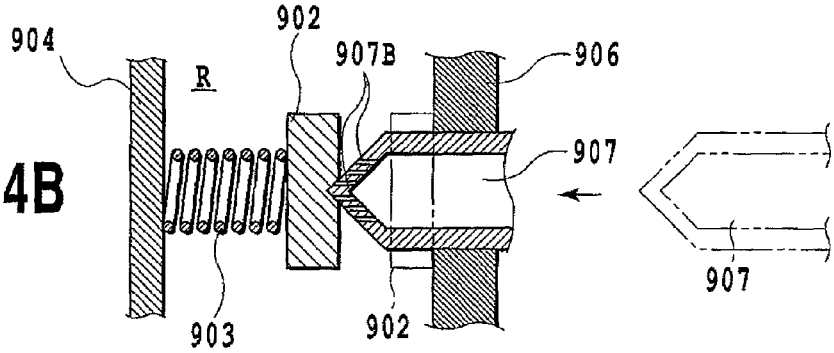
FIG. 14B is a cross-sectional view of a conventional supply connection portion in which a supply needle has a sharp tip with a plurality of small-diameter holes.
Figure 14C:
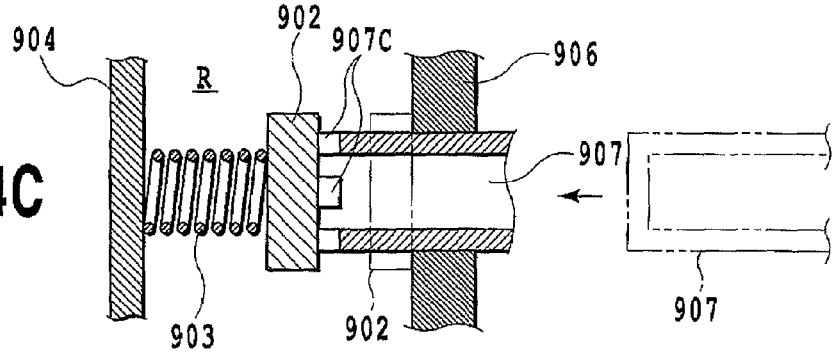
FIG. 14C is a cross-sectional view of a conventional supply connection portion in which a supply needle has an open tip with a recessed and projecting portion in its circumferential portion.
Figure 15:
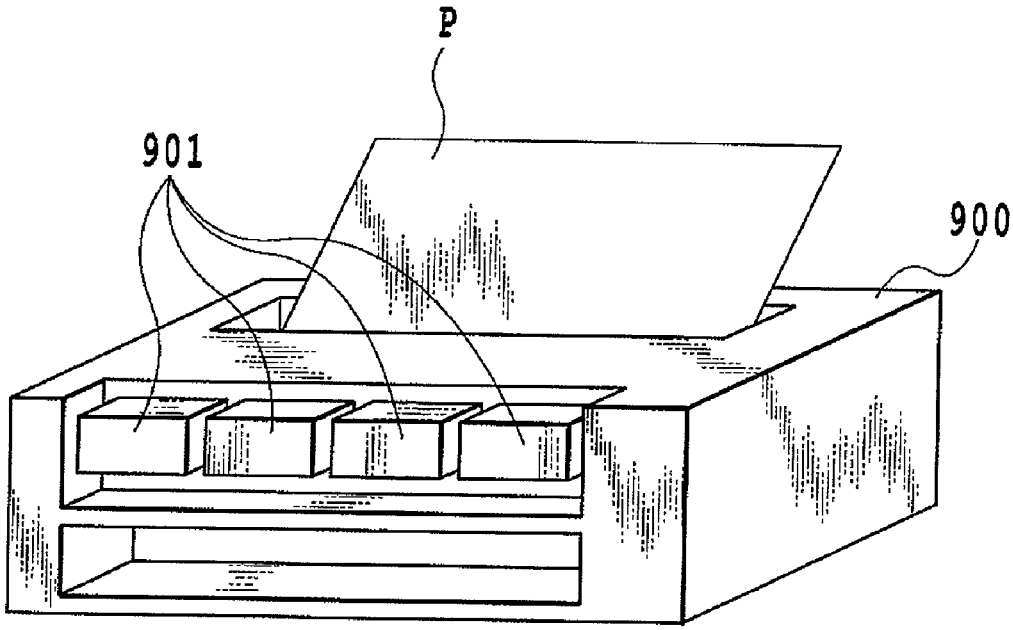
FIG. 15 is a perspective view showing a conventional ink jet printing apparatus.
Figure 16:
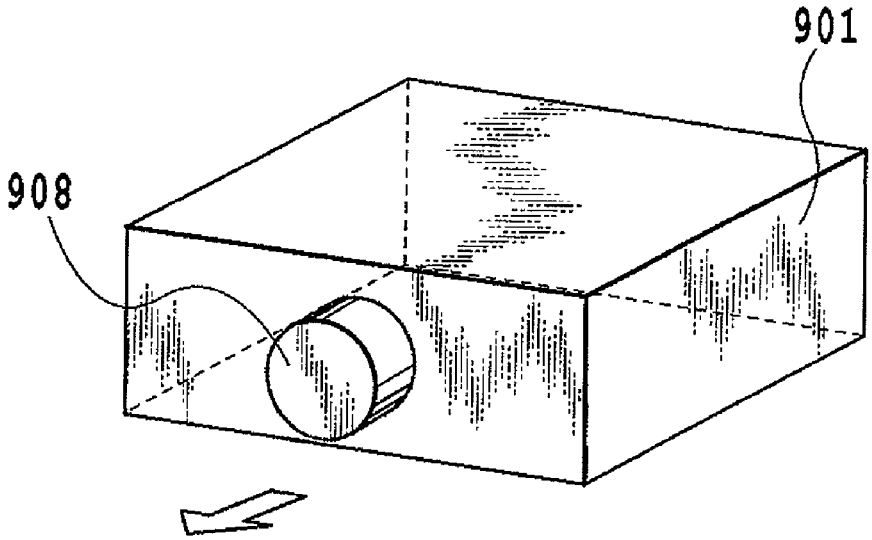
FIG. 16 is a perspective view showing a conventional ink tank.

FIG. 13 is a diagram showing a liquid container comprising a check valve 308. The check valve 308 allows a liquid to flow in an upward direction shown by arrow D1 but not in a downward direction shown by arrow D2. The bottom of the check valve 308 is in communication with the interior R of the liquid container R. For example, if the user inadvertently touches the supply needle 107 to push in the valve 102A in the direction of arrow A2, the above operation allows the valve 102A to keep the supply connection portion open. However, the check valve 308 is closed to prevent air from flowing into the liquid container. In normal use, the check valve 308 allows ink to flow in the direction of arrow D1 and does not prevent the supply of the ink.

Other Embodiments

The present invention is applicable not only to liquids such as ink but also to metal materials made liquid to allow a circuit to be printed on a substrate. Further, a printing apparatus using this liquid housing container as an ink tank has only to be able to print images using ink fed from the ink tank. Therefore, the printing apparatus is not limited to the serial scan ink jet printing apparatus, and its printing system or configuration is not limited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2006-212297, filed Aug. 3, 2006, which is hereby incorporated by reference herein in its entirety.

What is claimed is:

1. A liquid housing container comprising a liquid channel that is in communication with a liquid housing chamber and an opening and closing valve provided in the liquid channel and which is opened and closed by moving a valve element between an open position and a closed position, the liquid housing container further comprising:

a mechanism that alternately repeats a holding operation of holding the valve element in the open position and a releasing operation of releasing the holding of the valve element in the open position to allow the valve element to move to the closed position, every time the valve element is pushed in a direction from exterior to interior of the liquid housing chamber, wherein the mechanism comprises a rotor that moves alternately to one side or the other side in an axial direction every time the rotor rotates by a specified amount and an operation member that rotates the rotor by the specified amount every time the valve element is pushed from the exterior to interior of the liquid housing chamber, and the mechanism performs the holding operation when the rotor moves to one side and performs the releasing operation when the rotor moves to the other side.

2. The liquid housing container according to claim 1, wherein the valve element is pushed in a direction from the exterior to interior of the liquid housing chamber by a pipe connected to the liquid channel.

3. The liquid housing container according to claim 2, wherein the liquid channel comprises an elastic member having a hole through which the pipe is inserted, and the hole has an inner peripheral surface that comes into tight contact with an outer peripheral surface of the pipe inserted into the hole.

4. The liquid housing container according to claim 3, wherein the elastic member forms a valve seat on which the valve element is located.

5. The liquid housing container according to claim 1, wherein the valve element is pushed in a direction from the exterior to interior of the liquid housing chamber by a pipe connected to the liquid channel, and the pipe functions as the operation member.

6. The liquid housing container according to claim 1, wherein the mechanism comprises a rod that moves alternately to one side or the other side in an axial direction every time the valve element is pushed from the exterior to interior of the liquid housing chamber, and the mechanism performs the holding operation when the rod moves to one side and performs the releasing operation when the rod moves to the other side.

7. A liquid housing container comprising a liquid channel that is in communication with a liquid housing chamber and an opening and closing valve provided in the liquid channel and which is opened and closed by moving a valve element between an open position and a closed position, the liquid housing container further comprising:

a mechanism that alternately repeats a holding operation of holding the valve element in the open position and a releasing operation of releasing the holding of the valve element in the open position to allow the valve element to move to the closed position, every time the valve element is pushed in a direction from exterior to interior of the liquid housing chamber; and a check valve that permits a flow of a fluid from the housing chamber to the exterior through the liquid channel, while inhibiting a flow of the fluid from the exterior to the housing chamber through a fluid channel of the liquid channel, when the opening and closing valve is open.

8. The liquid housing container according to claim 7, wherein the valve element is pushed in a direction from the exterior to interior of the liquid housing chamber by a pipe connected to the liquid channel.

9. The liquid housing container according to claim 8, wherein the liquid channel comprises an elastic member having a hole through which pipe is inserted, and the hole has an inner peripheral surface that comes into tight contact with an outer peripheral surface of the pipe inserted into the hole.

10. The liquid housing container according to claim 9, wherein the elastic member forms a valve seat on which the valve element is located.

11. The liquid housing container according to claim 7, wherein the valve element is pushed in a direction from the exterior to interior of the liquid housing chamber by a pipe connected to the liquid channel, and the pipe functions as an operation member.

12. The liquid housing container according to claim 7, wherein the mechanism comprises a rod that moves alternately to one side or the other side in an axial direction every time the valve element is pushed from the exterior to interior of the liquid housing chamber, and the mechanism performs the holding operation when the rod moves to one side and performs the releasing operation when the rod moves to the other side.

* * * * *